US006240601B1

(12) United States Patent
Kiser et al.

(10) Patent No.: US 6,240,601 B1
(45) Date of Patent: Jun. 5, 2001

(54) METHOD AND APPARATUS FOR CONDITIONING TEXTILE FIBERS

(75) Inventors: Charles Eric Kiser, Louisville; Georges H. Brandan, Knoxville, both of TN (US)

(73) Assignee: Cotton Conditioners, Inc., Knoxville, TN (US)

( * ) Notice: Subject to any disclaimer, the term of this patent is extended or adjusted under 35 U.S.C. 154(b) by 0 days.

(21) Appl. No.: 09/556,358

(22) Filed: Apr. 24, 2000

(51) Int. Cl.[7] ..... D01G 7/00

(52) U.S. Cl. ..... 19/80 R; 19/66 CC; 19/66 R; 15/321

(58) Field of Search ..... 19/66 CC, 66 R, 19/80 R, 97.5, 200, 201, 204, 205; 15/321, 322; 68/5 R, 5 B, 8

(56) References Cited

U.S. PATENT DOCUMENTS

| | | |
|---|---|---|
| T975,001 | 10/1978 | Mangialardi, Jr. et al. . |
| 1,071,069 | 8/1913 | Marx . |
| 1,642,092 | 9/1927 | Smith . |
| 2,589,008 | 3/1952 | Lannan . |
| 2,747,234 | 5/1956 | Speakes et al. . |
| 2,809,772 | 10/1957 | Weisz . |
| 2,815,536 | 12/1957 | Bryant . |
| 2,834,058 | 5/1958 | Bryant . |
| 2,867,851 | 1/1959 | Mitchell et al. . |
| 2,873,483 | 2/1959 | Lytton . |
| 2,932,857 | 4/1960 | Smith . |
| 3,005,238 | 10/1961 | Manning . |
| 3,071,202 | 1/1963 | Lytton et al. . |
| 3,247,552 | 4/1966 | Bryant et al. . |
| 3,351,987 | 11/1967 | Wheelock . |
| 3,357,061 | 12/1967 | Jackson . |
| 3,451,105 | 6/1969 | Nayfa . |
| 3,954,401 | 5/1976 | Kling et al. . |
| 4,019,225 | 4/1977 | Nayfa . |

(List continued on next page.)

FOREIGN PATENT DOCUMENTS 297717 11/1967 (SU) .

OTHER PUBLICATIONS

Consistency—*CCA's Development of the New Top Feed Mount Offers Flexibility at a Reduces Cost of Application* Mar. 1998, vol. 1, Issue 5.

*Primary Examiner*—John J. Calvert
*Assistant Examiner*—Gary L. Welch
(74) *Attorney, Agent, or Firm*—Pitts and Brittian, PC

(57) ABSTRACT

A method and apparatus are provided for conditioning of textile, e.g. cotton, fibers as they are removed from bales for processing. A source of a conditioning liquid and a source of pressurized air are each in flow communication with a plurality of atomizing nozzles secured to a reciprocating fiber take-off device located above a plurality of aligned bales of fibers. As the removal apparatus moves back and forth across the upper surface of each bale, the nozzles dispense conditioning liquid directly onto the exposed upper surface of each bale. The fibers are thereafter entrained in an air flow for transport to further processing station(s). Within the stream of airborne fibers, one or more sensors detect the moisture content and/or other physical property(ies) of the fibers and sends an appropriate signal to a controller that individually controls the rates of flow of water to those spray nozzles associated with the entrained fibers and the rate of flow of conditioning liquid to the nozzles associated with the take-off device. Control of the flow of air and conditioning liquid provides for retention of conditioning liquid in a quiescent state at the exit of each conditioning agent spray nozzle in position to be substantially instantaneously uniformly sprayed in a fan-pattern onto the exposed surface of the bales. Further the control of the present invention minimizes any spray of the conditioning liquid beyond the end bales of the aligned bales of fibers.

20 Claims, 4 Drawing Sheets

U.S. PATENT DOCUMENTS

| | | | |
|---|---|---|---|
| 4,554,708 | | 11/1985 | Leifeld et al. . |
| 4,667,373 | | 5/1987 | Roder . |
| 4,943,300 | | 7/1990 | Vinnikov . |
| 5,040,270 | | 8/1991 | Mackey . |
| 5,072,490 | * | 12/1991 | Leifeld et al. ..... 19/80 R |
| 5,381,587 | | 1/1995 | Vandergriff . |
| 5,542,954 | | 8/1996 | Schrell et al. . |
| 5,677,273 | | 10/1997 | Schmid et al. . |
| 5,699,588 | | 12/1997 | Hsiung et al. . |
| 5,919,748 | | 7/1999 | Noguchi et al. . |

* cited by examiner

METHOD AND APPARATUS FOR CONDITIONING TEXTILE FIBERS

BACKGROUND OF INVENTION

This invention relates to methods and apparatus for conditioning textile fibers and particularly raw cotton fibers or blends of natural and synthetic fibers as the fibers are collected from individual ones of a plurality of bales of the fibers.

It is recognized in the textile industry that the moisture content of textile fibers can either beneficially or adversely affect the physical properties of the fibers. For example, cotton fibers processed at a moisture content between about 4% and 8%, are of maximum strength and elasticity. Cotton fibers processed at lower moisture contents, particularly below 4%, tend to be brittle and break, creating an excessive amount of broken fibers, leading to poor processing of the fibers into yarn, for example, and excessive waste of raw material and excessive quantities of "cotton dust" in the ambient environment of the processing facility. Waste and cotton dust raise the cost of environmental controls, cleaning of equipment and facilities, and disposal. Because cotton is an agricultural product, each bale contains fibers of different characteristics, in particular moisture content. The moisture level can vary even within a single bale, depending upon the environmental conditions in which the cotton is baled and stored, but baled cotton generally has a moisture level of about 3–4%. Accordingly, in the prior art, some processing facilities have attempted to control the humidity of the ambient environment of the processing facility through the use of moisture atomizers located externally of the processing equipment, but within the processing facility opening room and bale take-up, for example.

In modern fiber processing facilities, it has become common practice to enhance the speed of introduction of fibers into the processing facility through the use of a "lay down". This technique involves aligning a plurality of bales of the fibers so that the top surface of each bale is disposed substantially within a common horizontal plane. A vacuum device is passed over the exposed fibers of the top surfaces of the bales such that a small portion of the fibers of each bale is drawn from the bale, entrained in air and conveyed to further processing stations. The bales of a lay down are held in a warehouse or the like for a period of time, but even humidifying the warehouse has not adequately adjusted the humidity of the bales to a desired level before the bales are placed in a lay down. This process requires long times and cost, as well.

In similar manner, the trash content of bales may vary widely and/or the fibers may have some undesirable foreign material associated therewith and which adversely affects its processability. It has been known heretofore, for example, that frequently the moisture content of cotton fibers must be optimized in order to achieve optimum cleaning and processing. Accordingly, the humidity of the ambient air has been controlled in some cotton processing plants, and/or water has been added directly to the cotton fibers while yet baled or as they are removed from bales for processing. However, if too much moisture is added to the fibers or the moisture is added too rapidly (unbound moisture) the fibers tend to stick to one another, or to trash mixed in the bales, or to the processing equipment. In order to provide usable cotton for textiles, preferably a maximum amount of the trash is removed before the fibers are spun. The trash removal process, however, should not adversely affect the fibers themselves.

It has also been suggested heretofore that one can add various other fiber treating agents to the cotton fibers to enhance the ease and/or efficiency with which the fibers are collected, cleaned of trash, carded, and eventually spun into yarns. In the prior art, attempts also have been made to apply water and/or oversprays onto the fibers while they are entrained in air in a transfer duct, for example. In these fiber-treating techniques, the oversprays have comprised vegetable oils as lubricants, for example. Unfortunately, these oils, and other oversprays tend to collect on the equipment and accumulate cotton dust and dirt and other trash from the environment, requiring frequent cleaning of the fiber-handling equipment. Also, once applied to the cotton, the oils adversely affect the dyeability of the fibers. Over sprays as currently known to exist in the art fail to effectively perform their desired intended result, at least partly due to their inability to drive the moisture into the fibers. Rather, over sprays tend to discourage moisture absorption and thus accumulate surface moisture only and fail to enhance the processibility of the fibers.

U.S. Pat. No. 4,554,708 issued to Leifeld, et al discloses a system for collecting cotton from bales in which a truck travels back and forth along a set of rails adjacent to a plurality of bales of cotton. A bale opener assembly is cantilevered over the bales. As the truck moves alongside the bales, the bale opener assembly progressively removes the topmost fibers from the bales by vacuum suction. A liquid is sprayed downwardly in a conical pattern onto the exposed top layer of a bale of cotton fibers from nozzles mounted upon the trailing, side of the assembly. Provision is made for switching between different spray nozzles depending upon the direction of movement of the assembly. Otherwise, the disclosed system provides no control of the sprayed liquid so that this system is little more than another form of the prior art over spray technique. Further, this prior art system requires that the source of the liquid being sprayed be mounted on the truck, thereby limiting the quantity of liquid available to the system, resulting in inordinate down time for refills, etc. This factor defeats the primary purpose of a lay down, namely, saving of time.

The economics in the textile industry require the treatment of very large volumes of fibers. Any percentage of waste of raw fibers or treatment materials, such as conditioning agents, is of extreme economic significance. Moreover, excess application of conditioning agents causes fibers to agglomerate due to the presence of the excess liquid conditioning agent on the surface of the fibers. Disentangling these fibers during subsequent processing of the fibers is made more difficult, results in poor fiber alignment, poor cleaning, loss of fibers and unnecessary wear upon the processing equipment. In addition, the agglomerated fibers tend to entrap trash particles therein and increase the quantity of trash that continues with the cotton fibers into subsequent processing operations. This excess trash reduces the quality of the finished product and increases the wear on the production equipment. Alternatively, if the trash is aggressively removed, large amounts of cotton fibers are broken or lost with the trash. In the prior art attempts to enhance the processability of fibers, especially cotton fibers, there has been a failure to ensure retention of the applied moisture in that the moisture applied by the known prior art systems and methods tends to be lost as the fibers are conveyed (via air entrainment) through the ductwork and various work stations of the processing facility. Thus, in the prior art, even though a given moisture content of the fibers is initially established at the infeed station of the fibers to the processing facility, this moisture content is lost before the fibers are fully processed. In fact, the moisture content of the fibers decreases continually at the fibers are conveyed from station to station in the processing facility.

It is therefore an object of the present invention to provide a system for controlling the conditioning of textile fibers as the fibers are collected from one or more aligned bales of the fibers and prior to entrainment of the fibers for their transport into a textile mill, for example.

It is another object to enhance the control of the addition of a liquid conditioning agent to textile fibers to ensure proper take-up and retention of the desired moisture by the fibers.

It is also an object of the present invention to provide a system for monitoring the levels of conditioning agents, moisture, trash, sugar, polyester and other materials in textile fibers or blends thereof by adding tracers selective to such materials and measuring the amount of the tracers at a location in a flowing stream of the fibers and employing the information obtained to control the addition of water and/or a conditioning agent to the fibers prior to their being entrained for conveyance to a processing facility.

It is another object of the present invention to provide for the selective introduction of a choice of conditioning agents to fibers at or near the initial introduction of the fibers to a processing facility.

It is another object of the present invention to provide a method for enhancing the processability of textile fibers.

These and other objects of the present invention will become apparent upon a consideration of the drawings referred to hereinafter and a complete description thereof, plus the claims appended hereto.

SUMMARY OF INVENTION

In accordance with the present invention there is provided a method and apparatus for conditioning of textile, e.g. cotton, fibers as they are removed from bales for processing. A source of liquid conditioning agent and a source of pressurized air are each in flow communication with one or more atomizing nozzles secured to op of a reciprocating fiber removal apparatus located above one or more bales of fibers. As the removal apparatus moves back and forth across the upper surface of each bale, at least one nozzle dispenses atomized liquid conditioning agent onto the exposed upper surface of each bale thereby rendering the fibers suitable for the reception and retention of moisture internally of the fibers as opposed to mere retention of moisture on the external surfaces of the fibers. Preferably, only that nozzle or nozzle which is disposed on the leading side of the moving fiber removal apparatus is activated at a given time. The fibers are then entrained in an air flow for transport to further processing stations. Within the stream of airborne fibers, one or more sensors measure the moisture content and/or other physical property(ies) of the fibers. The sensor or sensors send a signal to a controller that controls the composition and quantities of application of conditioning agent, the quantity of water fed to the moving stream of fibers, and onto the exposed surface of the fibers in a bale by independently controlling the flow of the pressurized air and liquid conditioning agent. In similar manner, the moisture content of the fibers is controlled in response to the sensed moisture content of the fibers. Separate application of a specific liquid conditioning agent, followed by the addition of moisture to the conditioned fibers substantially adjacent their initial take-up into the processing facility has been found by the present inventors to result in retention of the moisture content of the fibers throughout their movement through the processing facility. By this means, the full benefit of conditioning and fiber moisture content is realized even to the end of the processing of the fibers into yarn and finished products.

BRIEF DESCRIPTION OF THE DRAWINGS

The above mentioned features of the invention will become more clearly understood from the following detailed description of the invention read together with the claims and the drawings in which:

DETAILED DESCRIPTION OF INVENTION

For purposes of clarity, the present description of the invention, at times, refers specifically to cotton fibers. Whereas the present invention is especially useful for processing cotton fibers, it will be recognized by one skilled in the art that the present invention may be employed when processing other fibers.

Figure 1:
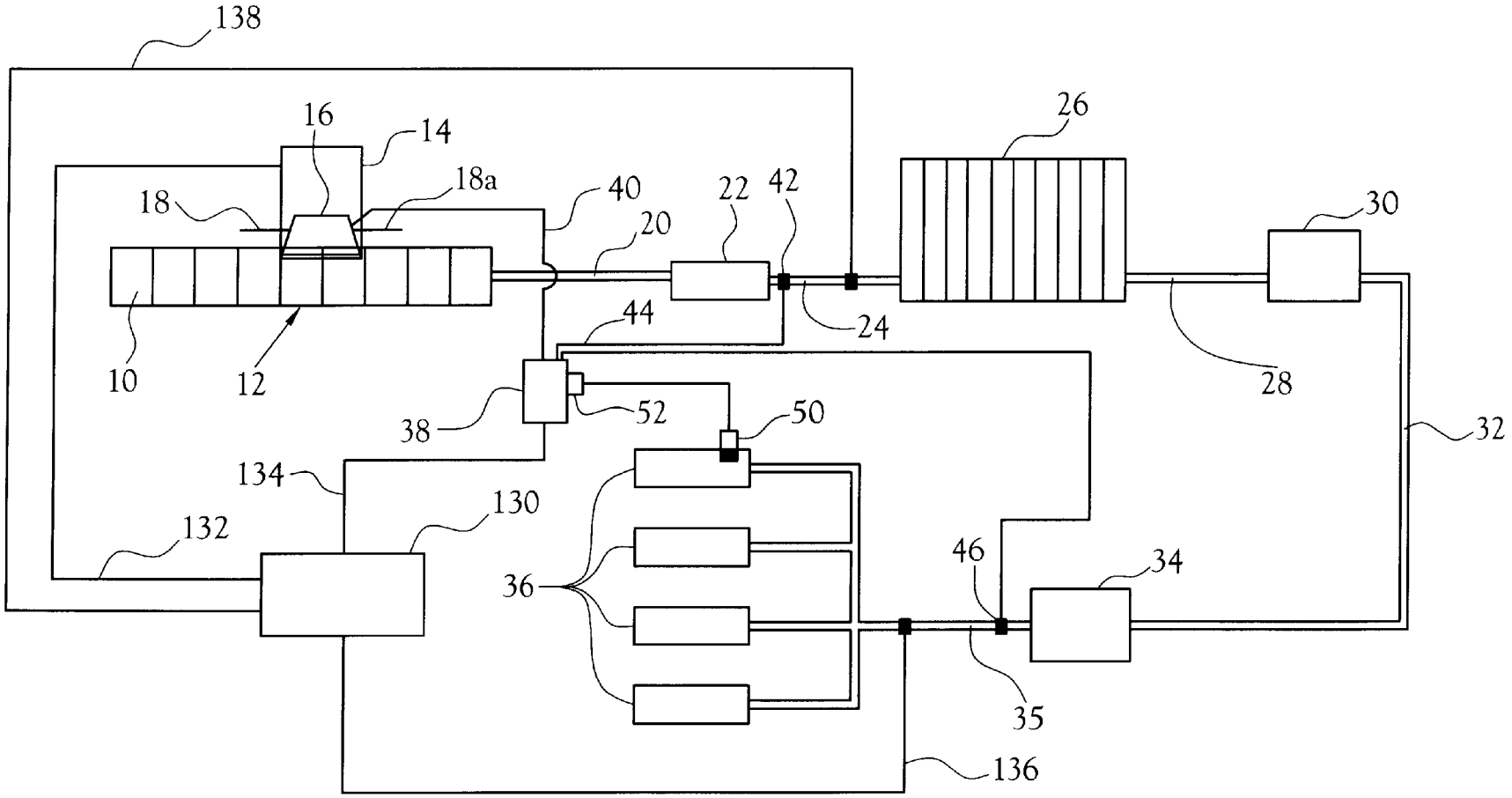
FIG. 1 is a schematic representation of a portion of a textile mill including a fiber conditioning system in accordance with the present invention.

A schematic drawing of a textile mill incorporating a system in accordance with the present invention is shown in FIG. 1. In a typical cotton textile mill, a plurality of open cotton bales 10 are aligned under the path of a reciprocating take-off device 14. This row of bales is often referred to as a laydown 12. The take-off 14 includes a vacuum hood 16 that is cantilevered over the bales and withdraws fibers from the bales 10 as it passes over the bales in a reciprocating path. Fibers are withdrawn from each bale on each pass of the hood 16 over the bales, irrespective of direction of travel of the hood. On each of two opposing sides of the take-off 14 is at least one spray applicator 18,18*a*. As fibers are drawn off of the bales, they are entrained in flowing air for transport through a conduit 20 to a first cleaner 22. After passage through the first cleaner 22 the fibers are transported through a conduit 24 for collection in a blender 26. After blending, the fibers are transported through a conduit 28, processed through a second cleaner 30, transported through a conduit 32 and processed through a third cleaner 34. Thereafter the fibers are transported through a conduit 35 to cards 36, where the fibers are aligned for spinning.

In accordance with the present invention, in addition to the water applied at the spray applicators 18 and 18*a*, a water atomizer 42 is interposed along the length of the conduit 24 between the first cleaner 22 and a blender 26. The water atomizer 42 is supplied with water from the dispensing unit 38 through a conduit 44 and pressurized air through a conduit 47. A second water atomizer 46 is located within the conduit 35 between the third cleaner 34 and the cards 36. The second water atomizer is supplied with water from the dispensing unit 38 through a conduit 48 and pressurized air through a conduit 49. Each of the water atomizers may be in the form of a solenoid-controlled nozzle such that the flow of water and pressurized air therefrom may be controlled as needed. A sensor 50 is located at one of the cards 36, for example, to continuously monitor the moisture content and/or other characteristics, e.g., physical properties, of the fibers as they enter the cards. In one embodiment, the sensor 50 may comprise a near infrared sensor. The sensor 50 is electrically connected to a controller 52 in the dispensing unit 38, as by lead 53, to provide the controller 52 with a signal indicative of the moisture and/or other sensed characteristic of the fiber blend entering the cards 36. If the moisture content varies from the preferred range of 4 to 8% for cotton fibers, for example, the controller causes the dispensing unit 38 to decrease, increase, or fully stop, as necessary, the amount of water being applied by one or both of the first water atomizer 42 and second water atomizer 46. The sensor 50 also may be used to identify the amount of trash still remaining among the fibers, the amount of polyester or other fibers mixed with cotton fibers, or the amount of sugar in cotton fibers, depending upon what tracers have been blended with the conditioning agent applied to the fibers. In response to detection of unacceptable levels of trash or sugar, for example, the chemical composition and amounts of conditioning agent and moisture can be adjusted.

Whereas a single sensor is depicted, it will be recognized that multiple sensors may be employed, each of which is capable of sensing one or more of the physical properties of the fibers which move past the sensor and is further capable of generating an electrical signal which is representative of each of the sensed physical property. Moreover, the location of a sensor within the system may be selected so as to provide optimum functioning of the sensor.

In the system depicted in the Figures, the dispensing unit 38 is connected through a conduit 70 to a source of pressurized water 71. The water supply conduit 70 is split into three conduits 70*a,* 70*b* and 70*c,* each of which is connected to a respective electrically-powered regulator 72*a,* 72*b* and 72*c,* each of which is electrically connected to the controller 52 as by leads 39,41 and 43, respectively, to selectively control the rate of flow of water through respective outlet conduits 74*a,* 44 and 48. As noted hereinabove, the outlet conduit 74*a* is connected to a water inlet 76 of a tee 75. The outlet conduit 44 is connected to the atomizer 42 located within the conduit 24 carrying entrained fibers from the cleaner 22 to the blender 26. The outlet conduit 48 is connected to the atomizer 46 located within the conduit 35 carrying entrained fibers between the third cleaner 34 and the cards 36.

Further, each of the atomizers 42 and 46 is connected as by respective conduits 47,49 through respective tees 51*a* and 51*b* interposed along a conduit 58 that leads from a source of pressurized air 55 which is held at a selected pressure, as by a pressure regulator 56. Solenoids 61,63 interposed within the conduits 47, 49, respectively, are connected via leads 65, 67, respectively, to the controller 52 for regulating the flow of air to the atomizers 42 and 46, such air flow serving to atomize the water which is supplied to each atomizer through their respective conduits 44 and 48. By this means, atomization of the water and whether there is water exiting a given atomizing nozzle 42 or 46, is controlled by the functioning of the solenoids 61,63, which in turn, are controlled through the controller 52.

The dispensing unit 38 is connected through a conduit 82 to a first source of conditioning agent 81, which, in one embodiment, comprises between about 50 and about 90% water as a carrier, between about 1 and about 20% wetting agents, and approximately 6 to 8% of a surfactant. Tracing agents may also be included to attach to trash in the raw cotton, to identify the amount of sugar in the cotton or to identify the relative amount of polyester fibers that have been blended with cotton fibers, for example. The composition of the first conditioning agent is selected to enhance the reception and absorption of water into the interior of the fibers, for example. The conduit 82 is connected to a variable speed pump 84, which is operatively connected to the controller 52 as by lead 85, to allow selective control of the rate of flow of the first conditioning agent to the second inlet 78 of the tee 75. Water and the conditioning agent are blended in the tee 75. The outlet 80 of the tee 75 is connected to the inlet of a solenoid valve 86. The outlet of the valve 86 is connected to a conduit 88 that supplies liquid conditioning agent to the diverter on the take-off 14.

In a preferred embodiment, there is provided a source of at least a second conditioning agent 81*a* which is in fluid communication with a second pump 84*a* by means of a conduit 82*a*. Each of the pumps 84 and 84*a* are electrically connected to the controller 52 as by leads 85 and 85*a* so that through selection of either of pump 84 or pump 84*a* for operation effects control over which of the first or second conditioning agents is fed to the conduit 88.

Figure 2:
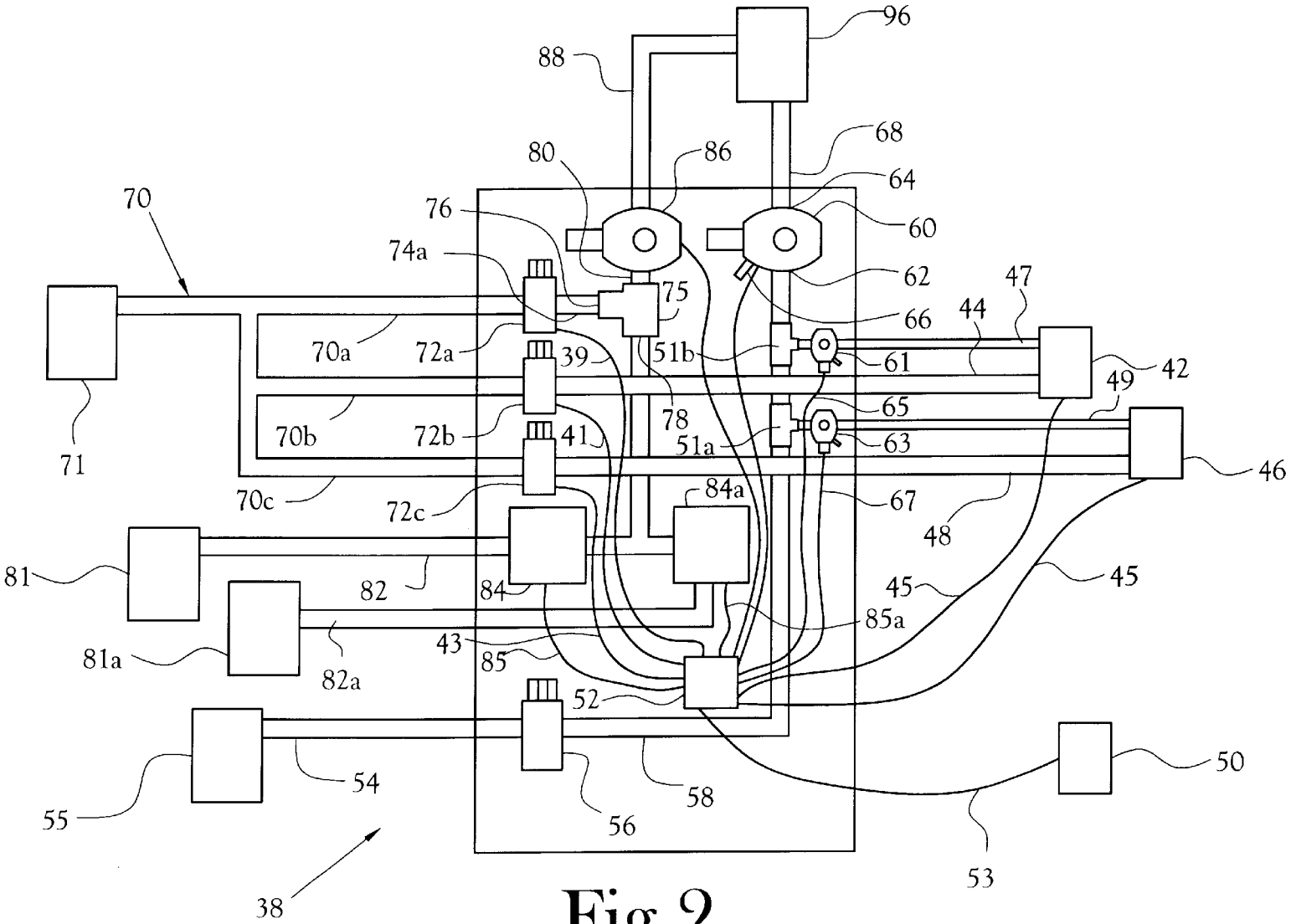
FIG. 2 is an schematic representation of a control system in accordance with the present invention.

Referring to FIG. 2, the dispensing unit 38 is connected through a conduit 54 to a source of pressurized air 55 at a pressure of at least about 60 psi, for example. The air conduit 54 is connected to a regulator 56 to maintain constant air pressure in an outlet conduit 58 which is connected to a solenoid valve 60 having an inlet 62, a primary outlet 64 and a secondary outlet 66. The primary outlet 64 is connected to a conduit 68 that supplies air to the diverter unit 96 on the take-off 14. The secondary outlet 66 is a bleed valve that releases air downstream of the valve 60 when the valve is closed, thus rapidly reducing the air pressure in the conduit 68.

Figure 3:
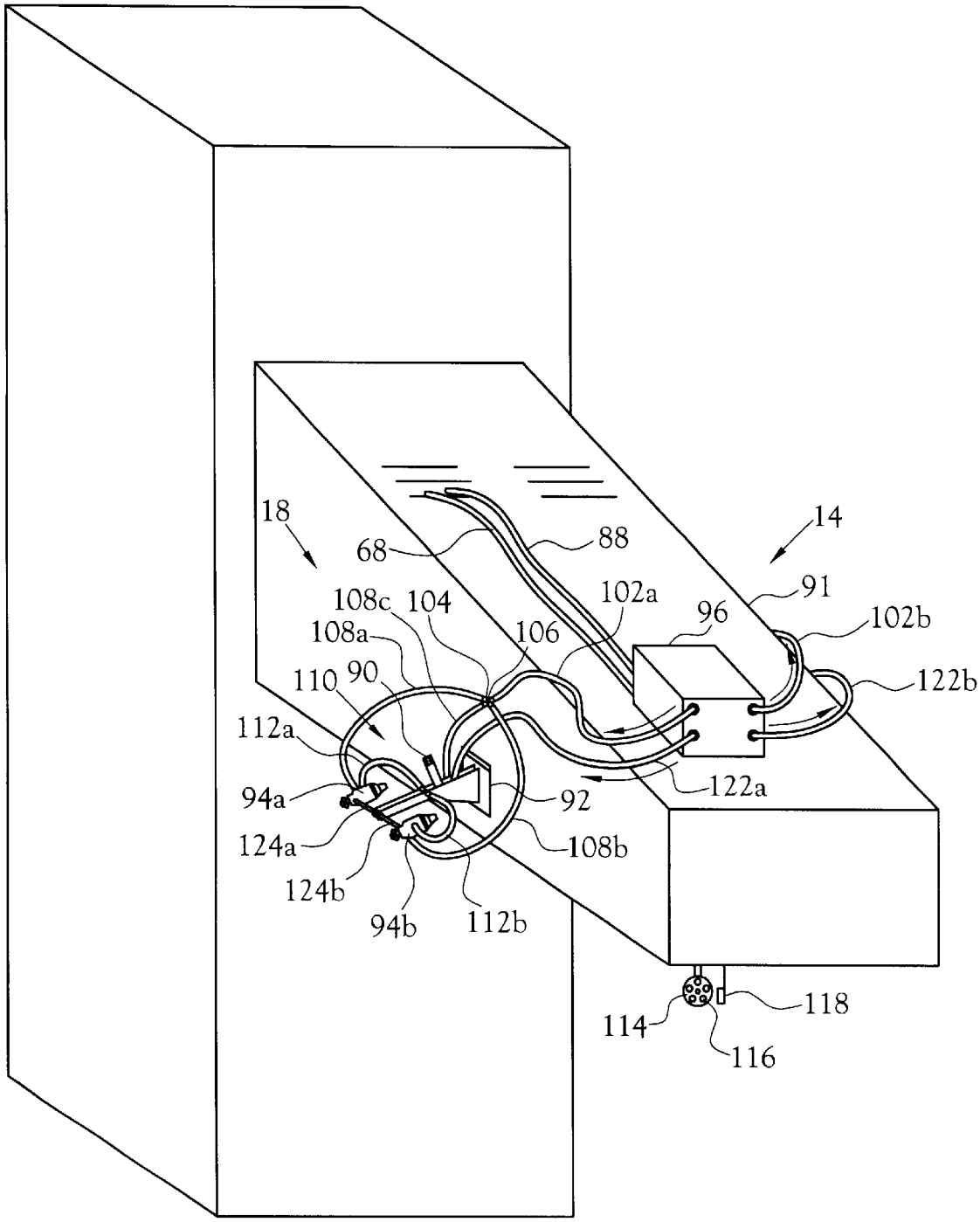
FIG. 3 is a schematic representation of a diverter unit of a control system in accordance with the present invention; and, FIG. 4 is a perspective view of a diverter system in accordance with the system of FIG. 1.
Figure 4:
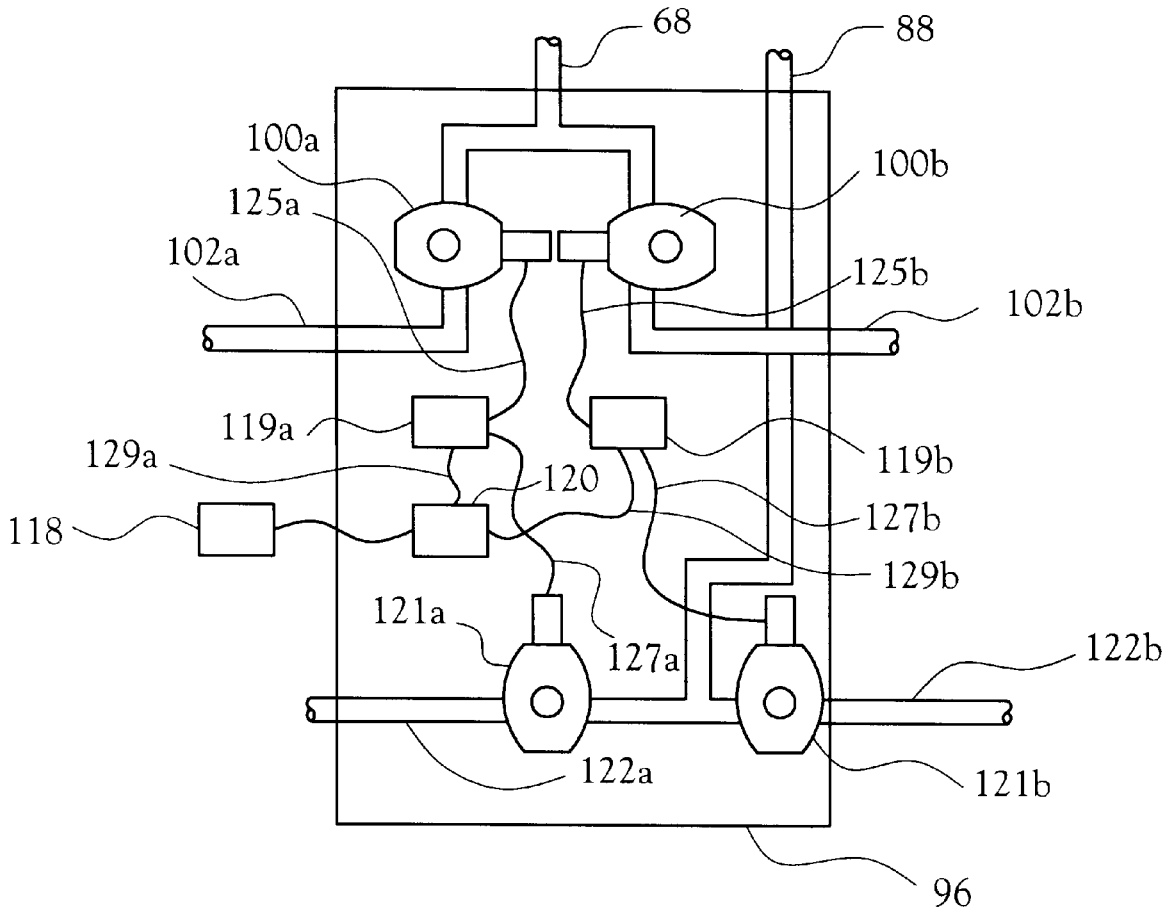

Referring to FIGS. 1, 3 and 4, a spray applicator 18, 18*a* is secured to each of the opposing sides of the take-off 14. Each spray applicator 18, for example, comprises a bracket 92 secured to the take-off 14. Only spray applicator 18 is depicted in FIG. 3 and it will be understood that spray applicator 18*a* is functionally essentially identical to the spray applicator 18. In the depicted embodiment, two spray nozzles 94*a* and 94*b* in an array are secured to the bracket 92 in an orientation which delivers from each nozzle a fan-shaped spray pattern of atomized liquid generally vertically downward onto the exposed fibers at the top end of the bales 10 as the take-off 14 reciprocates back and forth across the laydown 12. As noted, a spray applicator is mounted on each side of the take-off 14 so that conditioning liquid can be selectively applied to the exposed fibers on the top surfaces of the aligned bales and along the trailing side of the take-off 14 regardless of which direction the take-off moves. The array of nozzles 94*a* and 94*b* of each spray applicator are preferably located no more than 24 inches horizontally away from the take-off hood 16 and between 6 and 20 inches vertically from the upper surface of the bales 10. The plane of the fan-shaped spray from each nozzle is oriented substantially normal to the direction of movement of the take-off over the bales of cotton. By reason of the pressurized spray of the conditioning agent onto the top of each bale, the conditioning agent is driven into the fibers adjacent to the exposed top surface of each bale, thereby providing enhanced dispersion of the conditioning agent among the fibers. Thus these fibers are subjected to effective amounts of conditioning agent prior to their removal from the bales. As a result, the fibers are provided with an enhanced susceptibility to taking up moisture downstream as they are processed.

In the system of the present invention, at any given time in the operation of the system, there is provided a active single source of conditioning agent and a single source of pressurized air to each of the spray applicators 18,18*a*. By means of the diverter unit of the present system, these individual streams of fluid are divided into operative streams of conditioning agent and pressurized air fed to a plurality of spray nozzles that are located on each of the opposite sides of the top feed. Thus, the same conditioning agent, in the same amount, is made available to, and is deposited onto, the exposed top surfaces of all of the bales of cotton, irrespective of the direction of travel of the take-off, thereby providing for uniformity of conditioning of the fibers as a function of their measured physical property(ies) downstream of the take-off.

It is to be noted that the spray applicator 18 depicted in FIG. 3 is duplicated on the opposite side of the take-off as spray applicator 18*a* so that a description of the spray applicator 18 and its associated connections to the diverter 96 will provide a person skilled in the art with an understanding of the other spray applicator 18*a*. Moreover, whereas two spray nozzles are shown for each spray applicator, it will be recognized that a lesser or greater number of spray nozzles may be employed with each spray applicator, depending upon the capacity of each nozzle, the volume of conditioning agent which desirably is laid down on the exposed fibers of a bale, and the width of the bales, among other things.

Referring specifically to FIG. 4, the diverter 96 is mounted upon the take-off 14 to provide means for alternatively selecting which side of the take-off 14 receives pressurized air to open the nozzles of a respective spray applicator and atomize liquid conditioning agent being supplied to the nozzles.

The air supply conduit 68 supplies pressurized air at about 60 psi, preferably constant in pressure, from the dispensing unit 38 to the diverter. Via conduit 68, at the diverter, the inlet is split to provide fluid-flow connection for flow of the incoming air to two solenoid valves 100*a* and 100*b*. The outlet of the solenoid valve 100*a* is connected by a conduit 102*a* to the inlet 104 of a splitter 106 (see FIG. 3) having three outlet conduits 108*a*, 108*b*, and 108*c*. Outlet conduit 108*c* is connected to the inlet of an air pressure regulator 110. The air pressure regulator 110 has two outlet conduits 112*a* and 112*b*, each of which is respectively connected to the spray inlet of a nozzle 94*a* or 94*b*, respectively, to provide atomizing air. The regulator 110 controls the pressure of the atomizing air to about 5 to 10 psi. Each of the conduits 108*a* and 108*b* is respectively connected to a control inlet of the nozzles 94*a* and 94*b* to provide actuating air to open the nozzles 94*a* and 94*b*. The nozzles 94*a* and 94*b* are spring biased to close so that when the actuating air pressure falls below 45 psi, the nozzle is automatically closed. Preferably, the nozzles are self-cleaning. As depicted in FIGS. 3 and 4, air for activating the spray nozzles of the spray applicator 18*a* and for atomizing the liquid conditioning agent fed to these same nozzles is supplied from the solenoid 100*b* through the conduit 102*b*. Each of the solenoid valves 100*a* and 100*b* is electrically connected by leads 125*a*, 125*b*, respectively, through respective timers 119*a*, 119*b* to the controller 120.

Within the diverter the flow of conditioning agent available through the conduit 88 is divided between two conduits 122*a* and 122*b*. It is to be noted that the volume of conditioning agent available to each of the conduits 122*a* and 122*b* is established through the controller 52, as a function of some characteristic or property of the fibers being processed, as detected by the sensor 50. Within the diverter, solenoid valves 121*a*, 121*b* are interposed along the length of the conduits 122*a*,122*b*, respectively. From their respective solenoid valves, the conduits 122*a* and 122*b* lead to opposite sides of the take-off to supply liquid conditioning agent to the spray applicators 18, 18*a*. Each of the conduits 122*a* and 122*b* is again divided to provided for fluid communication of the liquid conditioning agent to each of two spray nozzles, nozzles 94*a* and 94*b*, for example, which are associated with a spray applicator, applicator 18, for example, as by means of conduits 112*a*,112*b*. Each of the solenoid valves 121*a*, 121*b* is electrically connected to a controller 120 as by leads 127*a* and 127*b*.

The movement of the take-off 14 is controlled by a main control panel 130 through a lead 132. When the main control panel 130 receives a signal from sensors in the conduits 24 or 35 through the leads 138 and 136, respectively, that more fibers are required, the panel 130 sends a signal to activate the take-off 14 and a similar signal is sent to the controller 52 via a lead 134.

As depicted in FIG. 4, means are provided for sensing movement of the take-off 14 and the direction of movement of the take-off. In the embodiment depicted in FIG. 3, a wheel 114 is rotatably mounted on the top feed 14 in a position to maintain the wheel 114 in frictional engagement with the laydown 12 or a portion of the mechanism that moves when the take-off 14 is in motion. The wheel 114 rotates in one direction when the take-off moves in one direction and rotates in the opposing direction when the take-off 14 moves in the opposite direction. A plurality of magnets 116 are secured on the surface of the wheel 114. A sensor 118 is mounted adjacent to the wheel 114 to detect motion of the magnets 116. The sensor 118 is electrically connected to the controller 120 which interprets the signal to identify motion and the direction of rotation of the wheel 114. As noted, the controller 120 is electrically connected by leads 129*a* and 129*b* to the timers 119*a* and 119*b*, each of which is electrically connected respectively to one of the solenoid valve sets 100*a* and 121*a* or 100*b* and 121*b*.

When the wheel is rotated by motion of the take-off 14, the sensor 118 communicates a first signal to the controller 120, which interprets the signal to determine that the take-off is moving and in which direction. The controller 120 communicates a signal to the timer connected to the solenoid valve controlling the upstream air conduit. The timer delays a signal to open the solenoid valve for a time period long enough to allow the upstream nozzles to reach the edge of the first bale, so that conditioning liquid is not wasted by spraying upon the floor beyond the laydown. When the take-off has traversed all of the aligned bales, the take-off 14 is stopped by the main control panel 130, which also sends a signal to the controller 52, which in turn closes the solenoid valve 60. To this end, the present invention provides for the retention of liquid conditioning agent at the exit of each spray nozzle where the liquid is in position to permit substantially instantaneously commencement of spraying of the liquid from the nozzles upon the commencement of flow of pressurized air to the nozzles and substantially instantaneous cessation of spraying of the liquid from the nozzles upon the cessation of air flow to the nozzles. Thus separation of the air flow from the liquid conditioning agent flow, including independent control over each of these flows, in combination with the detection of the movement and direction of movement of the take-off reduces undesired spraying of the conditioning agent beyond the end bales and enhances the uniformity of application of the conditioning agent to the bales and other desirable results.

When the take-off commences to move in its opposite direction, the sensor 118 detects the movement and direction of movement of the take-off and generates a second signal which is fed to the controller 120 which interprets the signal to identify motion and the direction of rotation of the wheel 114. Essentially, the functioning of the application of liquid conditioning agent to the tops of the bales is reversed when the direction of movement of the take-off is reversed.

In accordance with one aspect of the present invention, there is provided a method comprising the steps of (a) disposing at least one spray nozzle on each of the opposite sides of a take-off or an element of a take-off unit for vacuuming a layer of textile fibers, such as cotton, from the top end of a plurality of aligned bales of the fibers, (b) supplying pressurized air to each of said nozzles, (c) supplying at least one fluid conditioning agent to each of said nozzles, the quantity of conditioning agent being a function of one or more detected characteristics or physical properties of the fibers removed from said plurality of bales, (d) detecting one or more of the characteristics or physical properties of the vacuumed fibers, (e) generating a signal representative to the detected one or more properties, (f) detecting the movement and direction of movement of the take-off, (g) generating a signal which is a function of the movement of the take-off and of the direction of movement of the take-off, (h) regulating the flow of air and conditioning agent to one or more of the spray nozzles as a function of the position and direction of movement of the take-off and further as a function of the detected physical property of the vacuumed fibers.

In a preferred embodiment, the method includes maintaining conditioning agent present in a quiescent state at the exit of each of the spray nozzles while simultaneously maintaining essentially no pressurized air at the exit of each of the spray nozzles so that there is conditioning agent available at the exit of each nozzle for substantially instantaneous ejection upon the application of pressurized air at the nozzle, but there is no discharge of conditioning agent in the absence of such pressurized air. This feature permits the movement of spray nozzles beyond the end bales of a row of fiber bales without spraying (or dripping) of conditioning agent upon the floor or other nearby surface. This mode of operation of the present system is provided for by means of the sensing element for movement and direction of movement of the top feed, in combination with the solenoid-operated cut-off valves for the flow of conditioning agent and pressurized air, plus the use of independently controlled sources of pressurized air and conditioning agent.

In another aspect of the present method, the spray pattern of the conditioning agent is confined to a fan-type pattern in which the plane of the flat spray is oriented normal to the direction of movement of the top feed. The nozzles may be aimed laterally and vertically. By this means, there is provided enhanced control over the even distribution of the conditioning agent across each bale of fibers as the spray nozzles pass over the bales. This feature, coupled with the fact that conditioning agent is only dispensed when the take-off is moving, further both ensures uniform application of the conditioning agent and minimizes the quantity of conditioning agent required to effect a given desired modification of the fibers in anticipation of its being gathered from the bales and fed to the mill.

While a preferred embodiment has been shown and described, it will be understood that it is not intended to limit the disclosure, but rather is intended to cover all modifications and alternate methods and apparatus within the spirit and scope of the invention as defined in the appended claims.

What is claimed is:

1. Apparatus for the application of a conditioning agent from a source thereof to textile fibers during collection of the fibers from a plurality of aligned bales of textile fibers including the deposition of a liquid conditioning agent onto an exposed top layer of the bales of textile fibers, wherein a vacuuming take-off device having opposite sides is moved over the exposed upper surfaces of the bales to withdraw a layer of fibers from a bale as the take-off device passes over a bale and to convey the collected fibers in an air stream to a processing station, comprising:

at least one sensor for detecting at least one physical characteristic or property of said entrained fibers at a location downstream of the take-off device and generating a signal which is representative of said at least one physical characteristic or property of said entrained fibers and transmission of said signal to a controller, at least one first spray nozzle secured to the take-off device at a location adjacent to, but spaced apart from, the upper surfaces of the bales, said spray nozzle being suitable, when activated, to produce a uniform spray pattern of liquid conditioning agent onto the exposed fibers on upper surfaces of the bales prior to the extraction of the exposed fibers from the bales, a first conduit providing for fluid flow of liquid conditioning agent from a source thereof to said at least one first spray nozzle, a source of pressurized air, a second conduit providing for flow of said pressurized air from said source thereof to said at least one spray nozzle, valve means interposed along a length of said first conduit between said at least one spray nozzle and the source of said liquid conditioning agent for controlling the flow of liquid conditioning agent to said at least one spray nozzle, valve means interposed along a length of said second conduit between said at least one spray nozzle and said source of pressurized air for controlling the flow of pressurized air to said at least one spray nozzle, a controller receiving said signal generated by said sensor, said controller being in operative communication with said valve means for controlling the flow of said liquid conditioning agent and for controlling the flow of pressurized air to said at least one spray nozzle, whereby said controller, in response to said signal from said sensor, activates or deactivates said valve means to start and stop the flow of said pressurized air to said at least one spray nozzle.

2. The apparatus of claim 1 wherein said valve means comprises a single valve having multiple inlets and multiple outlets and the capability to selectively open said multiple inlets and multiple outlets, said source of liquid conditioning agent connected to one of said inlets and exiting said valve through one of said exits, said source of pressurized air connected to another of said inlets and exiting said valve through another of said exits, whereby operation of said single valve functions to control the flow of each of said liquid conditioning agent and said pressurized air to said at least one spray nozzle independently of each other.

3. The apparatus of claim 2 wherein said single valve comprises a solenoid valve.

4. The apparatus of claim 1 wherein said at least one spray nozzle comprises an array of spray nozzles which are disposed on the trailing side of said take-off device as the take-off device moves over the bales of fibers.

5. The apparatus of claim 4 and including a further array of spray nozzles which are disposed on that side of the take-off device opposite said array of spray nozzles.

6. The apparatus of claim 4 and including a further valve means interposed along the length of said first conduit between said valve means and said array of spray nozzles and said further array of spray nozzles, said further valve means dividing said liquid conditioning agent into separate streams, one of which is diverted to said array of spray nozzles and the other of which is diverted to said further array of spray nozzles, in substantially equal proportions.

7. The apparatus of claim 6 and including a further valve means interposed along the length of said second conduit between said valve means and said array of spray nozzles and said further array of spray nozzles, said further valve means dividing said pressurized air into separate streams, one of which is diverted to said array of spray nozzles and the other of which is diverted to said further array of spray nozzles, in substantially equal proportions.

8. The apparatus of claim 1 wherein said fibers vacuumed from said bales are entrained in air and conveyed via a conduit to a processing facility and including at least one moisture sensor disposed within said conduit for sensing the moisture content of the fibers and generating an electrical signal which is representative of said moisture content and transmitting said signal to said controller.

9. The apparatus of claim 1 wherein said moisture sensor comprises an infrared sensor.

10. The apparatus of claim 9 wherein said sensor generates a signal indicative of the amount of trash material mixed with said fibers.

11. The apparatus of claim 9 wherein said sensor generates a signal indicative of the sugar content of said fibers.

12. The apparatus of claim 1 wherein said textile fibers comprise raw cotton fibers.

13. A method of conditioning textile fibers disposed in a plurality of bales thereof wherein the bales are aligned and a quantity of fibers is withdrawn from an exposed top surface of the bales by a take-off device which is mounted for reciprocatory movement thereof over the exposed top surfaces of the aligned bales and fed to a processing facility comprising the steps of providing at least one spray nozzle on each of the opposite sides of the take-off device in position to apply a uniform atomized spray of liquid conditioning agent onto the exposed top surfaces of the bales of fibers as the take-off device moves over the bales of fibers, providing a source of at least one liquid conditioning agent for the textile fibers, providing a source of pressurized air, detecting one or more characteristics or properties of the fibers which are withdrawn from the bales by the take-off device and fed to the processing facility, generating at least one signal which is representative of each of the detected one or more physical properties of the fibers, detecting the movement and direction of the take-off device, generating a signal which is representative of the movement and direction of movement of the take-off device, employing said signal which is representative of one or more physical properties of the fibers, adjusting the flow of said at least one liquid conditioning agent to a substantially constant value to said at least one spray nozzle, and employing said signal which is representative of the movement and direction of movement of the take-off device, activating or deactivating flow of said pressurized air to a plurality of spray nozzles to thereby regulate the flow of conditioning agent from said at least one spray nozzle as a function of the detected physical property of the withdrawn fibers and as a function of the direction of movement of the take-off device.

14. The method of claim 13 wherein the flow of air and flow of conditioning agent are independently regulated.

15. The method of claim 13 and wherein said flow of air and flow of conditioning agent follows individually separate streams from their respective sources to a location adjacent said spray nozzles.

16. The method of claim 13 and including the step of maintaining liquid conditioning agent present at each of the spray nozzles in a quiesent state when said pressurized air is not flowing to the spray nozzles.

17. The method of claim 13 wherein said flow of conditioning agent onto the cotton bales is of a fan-shaped pattern, the plane of which is oriented substantially normal to the direction of movement of the take-off device.

18. The method of claim 13 wherein liquid conditioning agent is sprayed onto the exposed top surfaces for the aligned bales on the trailing side of the moving take-off device.

19. Apparatus for the application of a conditioning agent from a source thereof to textile fibers during collection of the fibers from each of a plurality of aligned bales of textile fibers including the deposition of the liquid conditioning agent onto an exposed top layer of the textile fibers of the bales of textile fibers, wherein a vacuuming take-off device having opposite sides is moved over the exposed upper surfaces of the bales to withdraw a layer of fibers from the bales as the take-off device passes over the bales and to convey the collected fibers in an air stream to a processing station, comprising:

at least one sensor for detecting at least one physical characteristic or property of said entrained fibers at a location downstream of the take-off device and generating a signal which is representative of said at least one physical characteristic or property of said entrained fibers and transmission of said signal to a first controller, at least one first spray nozzle secured to the take-off device at a location adjacent to, but spaced apart from, the upper surfaces of the bales, said spray nozzle being suitable, when activated, to produce a uniform spray pattern of liquid conditioning agent onto the exposed fibers on the upper surface of the bales prior to the extraction of the exposed fibers from the bales, a first conduit providing for fluid flow of liquid conditioning agent from a source thereof to said at least one first spray nozzle, a source of pressurized air, a second conduit providing for flow of said pressurized air from said source thereof to said at least one spray nozzle, valve means interposed along a length of said first conduit between said at least one spray nozzle and the source of said liquid conditioning agent for controlling the flow of liquid conditioning agent to said at least one spray nozzle, valve means interposed along a length of said second conduit between said at least one spray nozzle and said source of pressurized air for controlling the flow of pressurized air to said at least one spray nozzle, a controller receiving said signal generated by said sensor, said controller being in operative communication with said valve means for controlling the flow of said liquid conditioning agent to a substantially constant value which is a function of the sensed characteristic or property of the entrained fibers to said at least one spray nozzle, and for controlling the flow of pressurized air to said at least one spray nozzle, whereby said controller, in response to said signal from said sensor, activates or deactivates said valve means to start and stop the flow of said pressurized air to said at least one spray nozzle and thereby activate or deactivate the flow of liquid conditioning agent from said at least one spray nozzle.

20. The apparatus of claim 18 and including a further source of a further liquid conditioning agent, a conduit providing for fluid flow of said further liquid conditioning agent from said source thereof to said at least one first spray nozzle, valve means interposed along the length of said conduit between said at least one spray nozzle and said further source of said liquid conditioning agent for controlling the flow of liquid conditioning agent from said further source of a further liquid conditioning agent to said at least one spray nozzle.

* * * * *